US006651577B1

(12) United States Patent
Gates

(10) Patent No.: US 6,651,577 B1
(45) Date of Patent: Nov. 25, 2003

(54) PORTABLE MARINE OUTHAUL

(76) Inventor: Christopher C. Gates, 34 Hawthorn Rd., Brookline, MA (US) 02445

( * ) Notice: Subject to any disclaimer, the term of this patent is extended or adjusted under 35 U.S.C. 154(b) by 0 days.

(21) Appl. No.: 10/196,994

(22) Filed: Jul. 17, 2002

(51) Int. Cl.[7] ..... B63B 21/00

(52) U.S. Cl. ..... 114/230.23; 114/230.22; 114/230.26; 114/293

(58) Field of Search ..... 114/293, 294, 114/230.22, 230.23, 230.26

(56) References Cited

U.S. PATENT DOCUMENTS

| | | | | | |
|---|---|---|---|---|---|
| 2,364,262 | A | | 12/1944 | Wehringer | 242/97 |
| 2,952,236 | A | * | 9/1960 | Moyes | 114/230.23 |
| 3,063,402 | A | * | 11/1962 | Vallquist | 114/230.23 |
| 3,385,252 | A | * | 5/1968 | Sekkelsten | 114/230.23 |
| 3,838,657 | A | * | 10/1974 | Fleming | 114/230.22 |
| 4,303,037 | A | | 12/1981 | Helveston et al. | 114/230 |
| 4,353,307 | A | * | 10/1982 | Munson | 104/183 |
| 4,417,853 | A | | 11/1983 | Cook | 416/132 |
| 4,446,807 | A | | 5/1984 | Johnson et al. | 114/230 |
| 4,640,212 | A | | 2/1987 | Brandt | 114/230 |
| 4,666,127 | A | | 5/1987 | Allen | 254/281 |
| 4,721,054 | A | | 1/1988 | Kobayashi | 114/299 |
| 4,750,430 | A | | 6/1988 | Morton et al. | 104/114 |
| 4,756,128 | A | | 7/1988 | Danieli | 52/156 |
| 4,760,812 | A | | 8/1988 | Stanley et al. | 114/108 |
| 5,062,376 | A | | 11/1991 | Tremblay | 114/230 |
| 5,117,991 | A | | 6/1992 | Allen | 212/90 |
| 5,168,823 | A | | 12/1992 | Sheppard, Jr. | 114/230 |
| 5,390,618 | A | | 2/1995 | Wolff et al. | 114/230 |
| 5,398,634 | A | | 3/1995 | Eagan | 114/230 |
| 5,431,123 | A | | 7/1995 | Johnson | 114/295 |
| 5,460,112 | A | | 10/1995 | Travioli | 114/230 |
| 5,501,166 | A | | 3/1996 | Ziober | 114/230 |
| D371,760 | S | | 7/1996 | Ackley et al. | D12/317 |
| 5,566,636 | A | | 10/1996 | Wolf et al. | 114/230 |
| 5,806,453 | A | | 9/1998 | Cook | 114/230 |
| 5,992,787 | A | | 11/1999 | Burke | 242/388.1 |

* cited by examiner

*Primary Examiner*—S. Joseph Morano
*Assistant Examiner*—Lars A Olson

(57) ABSTRACT

A portable marine outhaul has a closed loop of line strung between pulleys attached to a pair of anchors, e.g. sea and land anchors, and used to keep a boat moored off a temporary shore. The outhaul uses a reel rotatably mounted inside a housing. One half or run of the line, preferably fed through one hole in the housing, is wrapped on one half of a spool of the reel. The other half or run is fed through a second hole in the housing, spaced from said first hole a sufficient distance to control tangling. This other run is wound in the same direction onto the other half spool of the reel. In a manually-operated form, a crank turns an axle attached to the center of the spool. Initially attached to either anchor, the outhaul unwinds until reaching the other anchor where it is attached. The two lines of the outhaul are then cleated or otherwise secured, preferably to the side of the container. This completes the outhaul loop. The boat is then attached to the loop and can be pulled off shore and on shore at will. When detached from the anchors and the boat, the line is rewound on the reel for transport or storage. In larger boats, the boat itself can become the housing.

17 Claims, 5 Drawing Sheets

FIG. 2B
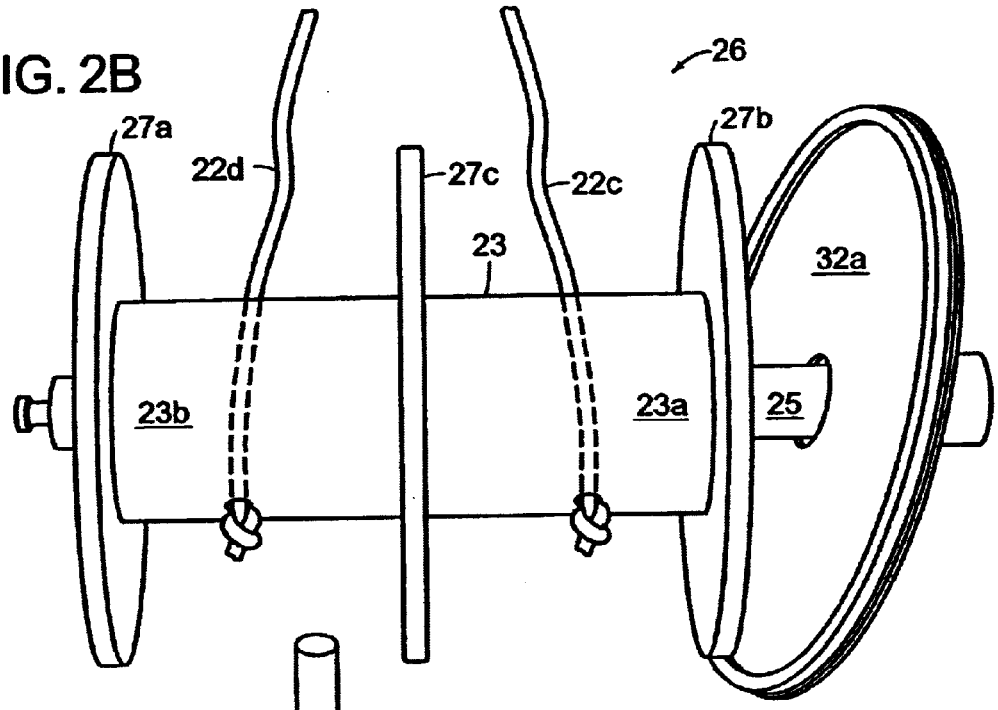
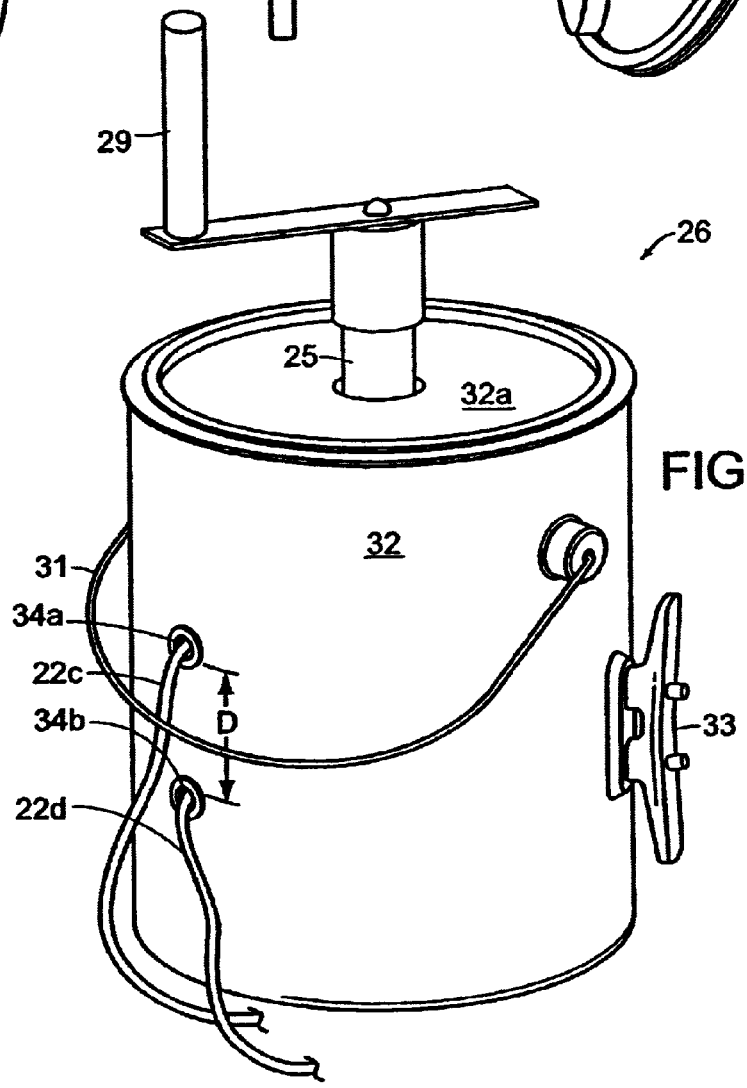
FIG. 2A

PORTABLE MARINE OUTHAUL

FIELD OF THE INVENTION

The present invention relates to temporary moorings for boats and other small watercraft. More particularly, the present invention relates to a marine outhaul apparatus and method which is portable and which allows the user, while visiting any shore which does not have docking facilities, both to moor and to retrieve the craft remotely from the shore.

BACKGROUND OF THE INVENTION

Access to shores of both lake and tidal waters which do not have a docking facility (undocked shores) has long been a problem for visiting boaters. While it is possible to land a boat at most shores, current and wave action bringing repeated contact between the boat and the shore can damage any boat, unless the boat can be pulled safely out of the water and on to the shore. This can only be done with very small boats like tenders and portable inflatable dinghies, on reasonably smooth shores. In tidal waters, tide changes require frequent adjustment of a craft's position on the shore. Some shores can only be visited at certain tides. There are many rocky undocked lake and tidal shores where it is not practical or safe to pull up any small boat.

For repeated visits to the same undocked shore, marine outhauls have traditionally been used as mooring devices. Such devices consist of an endless loop of line passing through pulley type devices, one of which is secured to an anchor on shore and another to an anchor in the water. When the water craft is attached to the loop (called the boat activation line) it can be moved from shore to the water anchor, or the reverse, by a remote user on shore pulling the boat activation line through the pulleys in the appropriate direction. Most outhauls are permanent or semi-permanent installations at one location. In tidal waters, various types of floating marine growth and floating debris can foul the device over time, jamming the pulley attached to the sea anchor.

Recreational boaters do not set up outhauls for temporary one-time use. Such outhauls are impractical because of 1) the time required to establish the two anchors and their pulleys and then to thread 300 to 400 feet of line through these pulleys, 2) the high risk of the line tangling in the set up, disassembly and storage, and 3) the problem of what to do with any line in the coil not needed for the particular application. Since one doesn't know how much line will be required for a particular application until arriving, the conventional outhaul user has to have a large coil of rope and hope it is long enough, but not too long. This makes it more cumbersome to assemble and store the line after use and to prevent tangles of the line in the process. These difficulties and the attendant frustrations outweigh the benefits of greatly increased access to previously unavailable shores which such an outhaul would provide.

The portable marine outhaul described here is designed to provide practical temporary safe mooring and remote retrieval for any watercraft able to land at any shore.

There are many patents that disclose, or relate to, a wide variety of marine outhauls. U.S. Pat. No. 4,760,812 by Stanley et al. relates to an outhaul used to secure a sail to the end of a boom of a wind surfing sailing craft. U.S. Pat. No. 4,750,430 by Morton and Scharte relates to an outhaul used between large ships for the transfer of cargo. U.S. Pat. No. 5,431,123 by Johnson and U.S. Pat. No. 5,806,453 by Cook relate to land anchoring devices for small boats. U.S. Pat. No. 5,398,634 by Eagan relates to a device used to anchor a boat safely at a dock, using a tubular device to contain and protect the line. U.S. Pat. No. 4,640,212 by Brandt relates to a special type of elasticized rope which can be used for the mooring of small water craft. U.S. Pat. No. 4,721,054 by Kobayashi relates to a device which makes it easier to pull up a small water craft anchor. U.S. Pat. No. 5,501,166 by Ziober relates to a watercraft mooring apparatus where the craft sits on a cradle for ease of pulling up on shore. U.S. Pat. No. 5,062,376 by Tremblay relates to a device used to anchor a small craft from bow to stern simultaneously with coordinated anchors, controlled by cables wound on a drum inside the boat. U.S. Pat. No. 5,460,112 by Travioli relates to an apparatus for pulling a small water craft upon a rocky shore using a supporting frame.

U.S. Pat. No. 5,168,823 to Sheppard, Jr. discloses a transportable outhaul device for recreational use which focuses on prevention of fouling of a pulley apparatus in the water at the sea-anchor end of the outhaul. It eliminates pulleys in favor of a hoop through which an "activation" line travels. While this outhaul may in fact perform well, particularly as a permanent or semi-permanent installation at one location over weeks and months when floating marine growth and debris can foul the line at the sea anchor end, it nevertheless fails to simultaneously meet a variety of often conflicting design considerations for a portable marine outhaul for use by recreational boaters.

The '823 outhaul is "transportable", but it is not practically portable for temporary use for the reasons mentioned above. The '823 patent describes using ⅜" line, which has a breaking strength far beyond the strength requirements for temporary use. However, this diameter line size does provide ease of handling and reduces the likelihood of tangling during set up, use and dismantling. Further, the 200 feet length described in the '823 patent is too short for many portable outhaul applications, yet it is quite bulky for portable use. The length is not adjustable for multiple locations. With outhauls, one size does not fit all.

OBJECTS OF THE INVENTION

It is therefore a primary object of the present invention to provide a marine outhaul apparatus and method that is portable and can be used at any required distance. This is generally 150 to 200 feet, requiring 300 to 400 feet of line, but longer applications are possible using this technology should a situation require them.

Another object of the invention is to provide a portable marine outhaul that allows onsite assembly of the outhaul and storage of unused line in a way which does not interfere with the operation of the outhaul.

Another object of the invention is to provide a portable marine outhaul that is readily disassembled and conveniently stored after use.

Still another object is to provide a portable marine outhaul with the foregoing advantages that controls tangle of the outhaul line and is comparatively easy to use.

A further object of the invention is to provide a portable marine outhaul that is versatile, allowing visits ranging from a few minutes to a few days to any undocked shore of almost any type, ranging from rocky lake shores to very gradually sloped tidal shores.

Another object is to provide a portable marine outhaul with the foregoing advantages that can be used to moor at sea or between land anchor points.

Yet another object is to provide a portable marine outhaul that can be manufactured at a favorable cost using standard materials and components.

BRIEF SUMMARY OF THE INVENTION

This invention provides a marine outhaul having two pulleys that are each attached to an anchor, a reel, and a loop, of haul line journalled through the pulleys, establishing two runs. In one form, each end of the haul line is secured at opposite ends of the reel, wound in the same direction to wind or unwind both runs simultaneously with rotation of said reel in one direction or another.

In one form, the invention provides a portable marine outhaul for a vessel that can be set at a variable distance from an anchor point on land. One anchor is then a land anchor and the other is a sea anchor. When using a sea anchor, a line is secured to a float. The reel and haul line wound on the reel are constructed to wind and unwind the haul line as two mutually spaced runs of generally equal length. A pair of pulleys carry the haul line, one of the pulleys being releasably secured to a sea anchor and a float, and a second of the pulleys being releasably secured to the land anchor. A mechanical arrangement, for example a cleat mounted on the reel container, secures the haul line when unwound from said reel to a predetermined length. The invention includes a mechanical arrangement for securing the haul line to the vessel, e.g., a cleat mounted on the hull of the vessel.

Drawing on one of the runs causes the haul line and the attached vessel to travel between the pulleys and their associated anchors in a first direction. Drawing on the other one of the runs causes the haul line and the attached vessel to travel in the opposite direction.

In other forms, the outhaul can be set between two sea anchors or two land anchors to provide a mooring, while also allowing some degree of change of location on the water, e.g. to a different fishing or photographic site.

Viewed as a method, the invention provides a process for mooring a floating marine vessel at a variable distance between two anchor points. In a preferred form, the process, broadly stated, includes setting a sea anchor; attaching a float to the anchor line; securing a reeled, double-run haul line to the sea anchor line; unreeling two runs of the haul line in coordination with a movement of the vessel from the sea anchor to the land; detachably securing the haul line to the land anchor; securing the haul line to a cleat on the container at the length unreeled during the movement and the detachable securing; fixing the haul line to the vessel; and pulling on one run of the haul, line thereby to move the vessel from land toward the sea anchor. In a dual sea anchor form, once one sea anchor is set, the movement is to a second sea anchor. In a dual land anchor form, one land anchor is set, then the boat is moored to a second land anchor while unwinding the haul line from the reel.

These and other features and objects of the invention will be more fully understood from the following detailed description which should be read in light of the appended drawings.

BRIEF DESCRIPTION OF THE DRAWING

FIG. 2A is a view in perspective of the outhaul reel shown in FIGS. 1 and 1A;

FIG. 2B is an enlarged view of the spool of the reel shown in FIGS. 1A and 2A with outhaul lines partially unreeled;

DETAILED DESCRIPTION OF THE INVENTION

Figure 1:
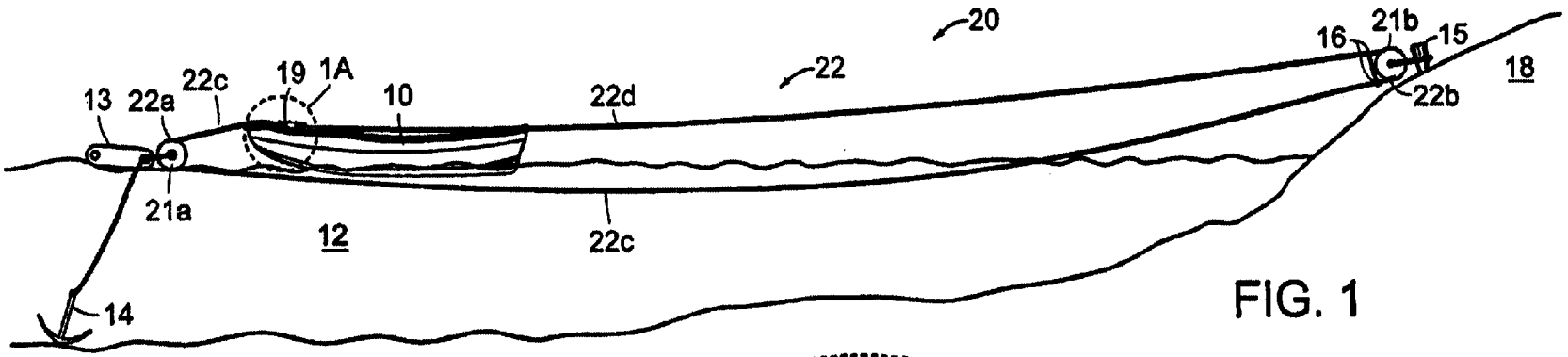
FIG. 1 is a simplified view in side elevation of the portable marine outhaul of the present invention in use to temporarily moor a small boat offshore between sea and land anchors.

FIG. 1 shows in a simplified schematic view a boat 10 moored in a body of water 12 between a sea anchor 14 and land anchor 15 secured on a shore 18. The boat is attached at point 19 to a portable marine outhaul that includes a line 22 journalled at a sea-end 22*a* on a pulley 21*a* attached both to float 13 and to sea anchor 14, and at a shore-end 22*b* on a pulley 21*b* attached to land anchor 15. A knot (shown schematically) between lines 22*c* and 22*d* at point 16 prevents line 22*d* from passing though pulley 21*b*, thereby keeping boat 10 close to sea anchor 14 once it has been run out from the shore. The line 22 constitutes two runs 22*c* and 22*d* of generally equal length, that each extend between the journalled sea and land ends 22*a* and 22*b*. In waters cluttered with floating marine growth and debris, a floating ring 21*c* (FIG. 3C) can be substituted for sea pulley 21*a*.

Figure 1A:
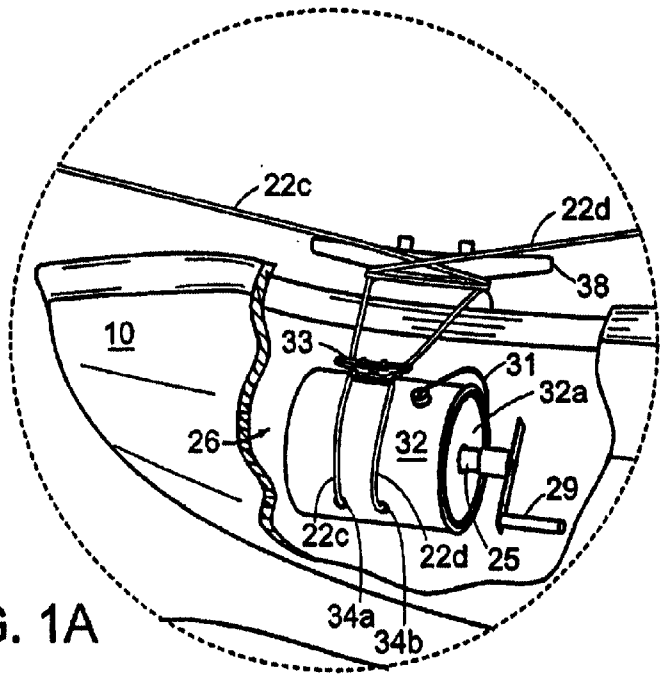
FIG. 1A is a detailed view in perspective of portion 1A of FIG. 1 of the outhaul line runs secured at a given length and secured to the small boat.

FIG. 1A is a detail of the outhaul container 32 stored in boat 10 while the portable marine outhaul is in use. Lines 22*c* and 22*d* are shown passing from the container to cleat 33 on the outhaul container, which was used to establish the outhaul before it was attached to the boat. Attachment to the boat is achieved by fastening the lines 22*c* and 22*d* which already have been fastened to the outhaul container cleat, to boat cleat 38. This connects the boat to the outhaul which controls the position of the boat by drawing on lines 22*c* or 22*d*. This also disconnects the established outhaul from the outhaul container which stores the unused line.

Figure 2C:
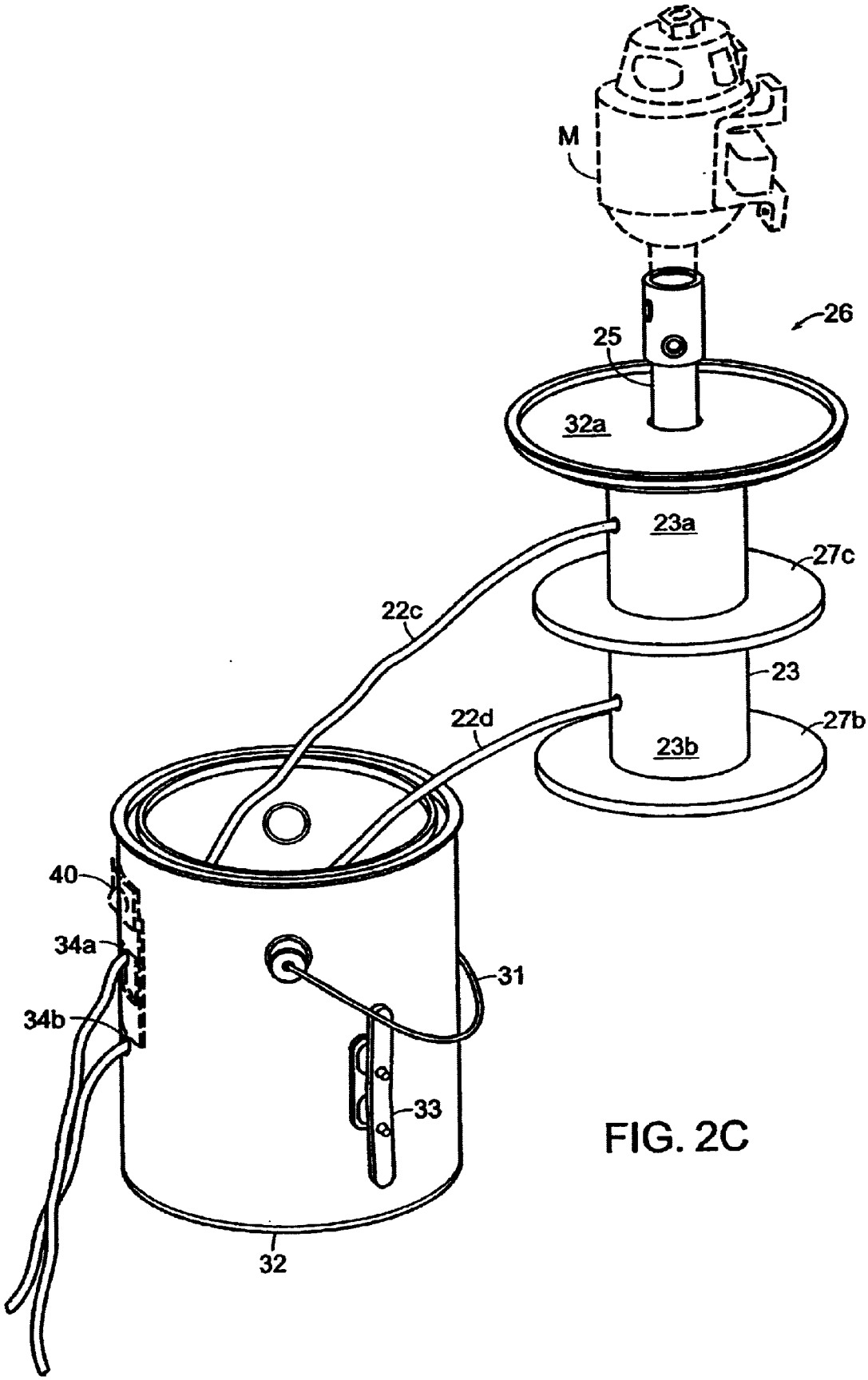
FIG. 2C is an exploded perspective of an alternate reel construction.

FIGS. 2B and 2C show the two ends of line 22 attached to the spool 23 of reel 26. The reel 26 is made up of spool 23 and flanges 27*a*, 27*b* and 27*c*. Each run 22*c* and 22*d* is secured to, and wraps on and off, a different half of the spool 23 of the reel 26 separated by a midline flange 27*c* of reel 26. A spool 23 of the reel 26 is rotatably mounted on its axle 25 that is supported by and turns in end walls of an exterior housing 32. A pair of openings 34*a*, 34*b* in the generally cylindrical side wall of the housing 32 each receive one of the runs 22*c* and 22*d*. (The line 22 in its preferred form is not a closed loop, but one length that can be viewed as "doubled back" in an elongated U-shape, with the free ends secured to the reel to close the outhaul loop.)

In one form, the openings 34*a*, 34*b* are generally circular, with a small annular clearance around the associated line run. They can be lined with a low friction material to reduce abrasion and wear of the line as it passes through or is bent over the openings. The openings 34*a*, 34*b* are separated by a sufficient distance D that they resist the tendency of the lines to cross and tangle. The openings are also positioned so that they are each opposite, and direct their line run to, an associated "half" 23*a*, 23*b* of the spool. The guiding and separation function of the holes 34*a*, 34*b* can, of course, be effected in many other ways well known to those skilled in the art. However, the holes 34*a*, 34*b* in a housing are presently preferred in that they are a simple and economical structural implementation. Flanges 27*a*, 27*b* and 27*c* are not required for most diameter lines, but are included as an extra precaution against winding and unwinding tangles in lines 22*c* and 22*d*. Moreover, the use of a housing that, except for the holes, substantially encloses the portion of the line 22 that is wound on the reel 26 has the added advantage that it protects the line from mechanical forces and atmospherics that can degrade it.

Figure 3A:
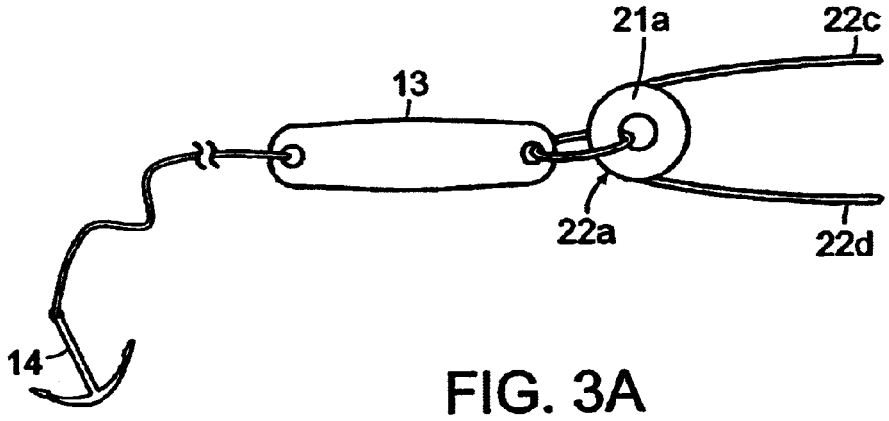
FIGS. 3A and 3B are detailed views in side elevation of the sea and land anchor connections, repectively, shown in FIG. 1.
Figure 3B:
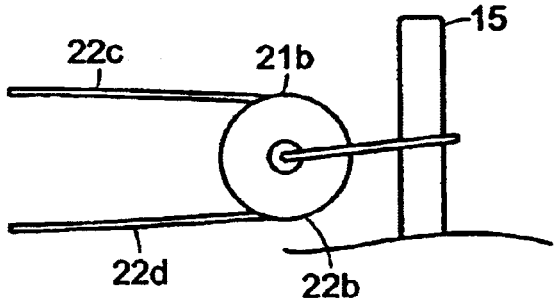
Figure 3C:
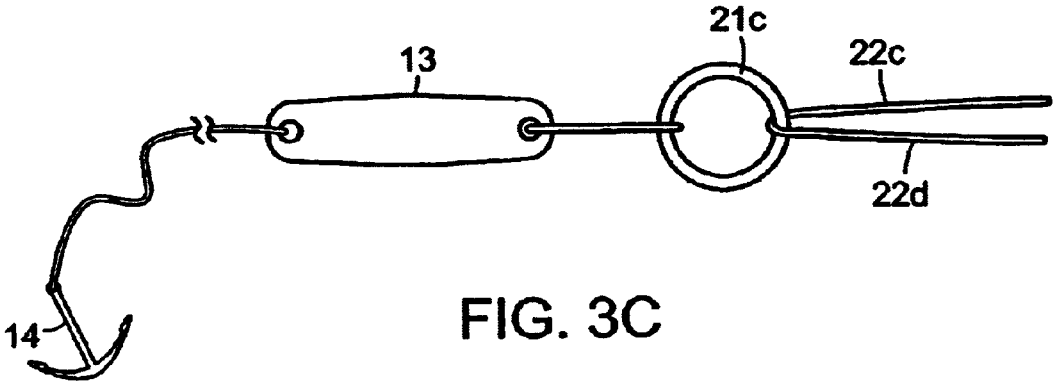
FIG. 3C shows an alternative sea anchor connection.

FIGS. 2B and 2C show the outhaul 20 fully unreeled. The line is preferably a closed loop of line wound on the spool 23 of the reel 26 with portions of two line runs 22*c* and 22*d* emerging from guide holes 34*a*, 34*b*. Attached to runs 22*c* and 22*d*, although shown in other figures, e.g. FIGS. 3A and 3B, are the two pulleys 21*a* and 21*b*. Also. shown in FIG. 3C is ring 21*c* substituted for pulley 21*a* at the sea anchor end of the outhaul.

Crank 29 in FIG. 2A is shown removably secured to one end of the axle 25. through hole 29. The container is carried by a handle 31. Cleat 33 secures both line runs 22*d* and 22*d* and thus establishes the closed loop outhaul of a preselected length for a particular application.

By way of illustration, but not of limitation, the following gives the details of a prototype of a portable marine outhaul according to the present invention that has been used successfully. Part numbers refer to those used in FIGS. 1–3C with respect to a more generalized embodiment of the invention. The prototype is for boats under 20 feet. It uses a 2 gallon plastic can as the reel housing 32 with a removable friction-fit lid 32*a*, and 400 feet of ⅛ inch diameter line 22.

Reels 26 for these prototypes have been constructed using 1⅞" PVC pipe for the spool material and ⅛" plywood discs for flanges, with a 1⅞ inch center hole and proper diameter to fit into the container. A 1 inch hardwood dowel serves as the axis 25 fastened through the bottom of the container, 32 with rotating screw 35 and fastened to flanges 27*a* and 27*b* which are attached to spool 23.

The handle for crank 29 is 1 inch diameter dowel with a 5/16"' inch axial hole housing a ¼ inch bolt attached to one end of a ½ inch hardwood dowel (with a reinforcing metal sleeve) which is the crank arm. This arm removably passes through the metal sleeve reinforced top of axle 25.

A vertical cleat 33 is attached to the side of the housing 32, at the midpoint. Offset from the cleat 90 degrees, ½ inch holes 34*a* and 34*b* are drilled in the side of the housing half way between the midpoint and the bottom and half way between the midpoint and the top. Two ¼ inch holes are drilled in the spool lined up with holes 34*a* and 34*b* of the container.

Four hundred feet of ⅛th inch line provides up to 200 feet of separation between the anchors. Each end of the line passes through a separate hole 34*a*, 34*b* into the housing 32 and attaches to that half of the spool which will be closest to the hole when the reel is positioned inside the container. One end of the line 22 is passed through hole 34*b* in the housing and then passed through the lower hole in the spool, and secured there with a knot. The other end of line 22 is passed through hole 34*a* of the housing and passed through the upper hole in the spool. It is also then knotted. The line runs 22*c*, 22*d* then wind and unwind from the spool halves 24*a*, 24*b* in unison, with the midline separator disc 27*c*, and the openings 34*a* and 34*b* cooperating to keep the lines separated and resist tangling.

The crank 29 is fitted into its associated axle 25, the cotter pin (not shown) inserted, and the axle turned (either direction) to wind the line into the container onto the spool 24. When this is complete, only a 4-inch length of line extending between the holes 34*a*, 34*b* and the two attached pulleys 21*a*, 21*b* are outside the container 32. The assembled portable marine outhaul 20 is now ready for operation.

The portable marine outhaul unit 20 is transported to a mooring site. In a mode of use where the outhaul 20 is transported by land to the docked boat 10, or stored on the boat, and where after boating it is desired to land on the shore 18 without docking facilities and otherwise not accessible, the anchor 14 is set at a safe distance off shore. A float or buoy 13 is attached to the top end of the anchor line. One of the pulleys, 21*a* as shown, attached to the closed end midline of the loop 22 is also attached to the buoy 13 and to the line of anchor 14, e.g. as shown in FIGS. 1 and 3A.

The boat 10 is then taken to shore 18, with the outhaul loop unwinding in the process. A land anchor 15 is set (or found, e.g. a naturally occurring fixed structure such as a tree or rock) at an appropriate distance from the water's edge. The second outhaul pulley 21*b* is attached to this land anchor 15, e.g. as shown in FIGS. 1 and 3B. When both pulleys 21*a* and 21*b* are attached to their anchors, the two line runs 22*c* and 22*d* forming the outhaul loop are pulled taught and cleated to the side of the outhaul container 32 as shown in FIG. 1A. This establishes the outhaul for this application. Any excess line which has unreeled, is reeled back into the container 32. The container 32 is then taken to the boat 10 at the water's edge, causing the outhaul loop 22 to pass through the pulleys 21*a*, 21*b*, ring(s) 21*c*, or equivalent structures. (For convenience, as used herein, "pulley" will be understood to include all these components and equivalent devices and arrangements.) In a preferred form for use with recreational boats, the outhaul loop 22, just beyond where it is cleated to the container, is replaceably attached to the boat 10, as shown in FIG. 1A where the line runs 22*c* and 22*d* from the cleat 33 to cleat 38 attached to boat 10. The boat, with the outhaul container housing the unwound line 22 in it, is then moved off shore by pulling in on the run 22*c* of the line 22 between the pulleys.

When the boat is safely off shore, the outhaul lines 22*c*, 22*d* carried on the pulley 21*b* at the land anchor are tied together, or otherwise clamped or secured, as denoted by reference numeral 16 in FIG. 1. This prevents the outhaul line from passing through the pulleys and ensures that the boat will remain where it is, until this knot is untied, or the clamp (e.g. slide clamp 40 shown in FIG. 2C) or other securing means released.

It is also possible to set up the outhaul in reverse order, going through the above steps but starting by first attaching to the land anchor 15.

Disassembly involves detaching each anchoring end, detaching the lines from the boat and container cleats and reeling the loop back into the container under mild tension to ensure tight winding, a quick and easy process.

For larger boats able to make a shore landing, the outhaul reel can be permanently attached to the boat 10. The reel 26, line 22, and supports 32, 32*a* for the reel can be enclosed in the boat itself. The boat, in effect, becomes the outhaul reel container. Appropriately larger line and snatch blocks. (rather than pulleys) are preferred. Setting up and dismantling the outhaul are the same process, and it is possible to start at either the land anchor end or the sea anchor end. The reel in such installations can be power driven, e.g. using a motor M shown in phantom in FIG. 2C.

Figure 4:
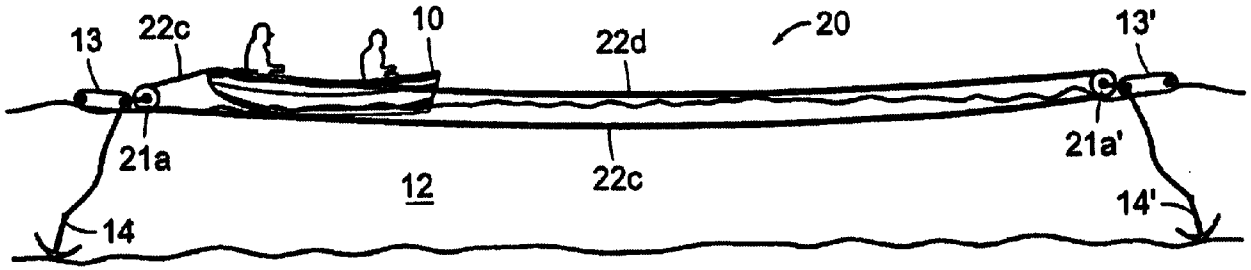
FIGS 4 and 5 are views corresponding to FIG. 1 that show alternative embodiment using only sea anchors and only land anchors, respectively.

FIG. 4 shows an alternative embodiment of the invention where two sea anchors 14 and 14' are set at a preselected distance from one another and the portable marine outhaul is set between them. First one sea anchor 14 or 14' is set as described above, with a float or buoy 13 or 13' and an associated pulley 21*a* or 21*a'*. The boat then travels, while unwinding the outhaul line 22, to a second anchor site where the second sea anchor 14 or 14' is set in the same manner. The line is secured at the desired length, e.g. by cleating off the line on the cleat 33, and then both lines 22*c*, 22*d* are secured to the boat. By pulling on one run, the boat can then be maneuvered between the anchor points, e.g. to allow a change in a fishing site, photographing position, etc.

Figure 5:
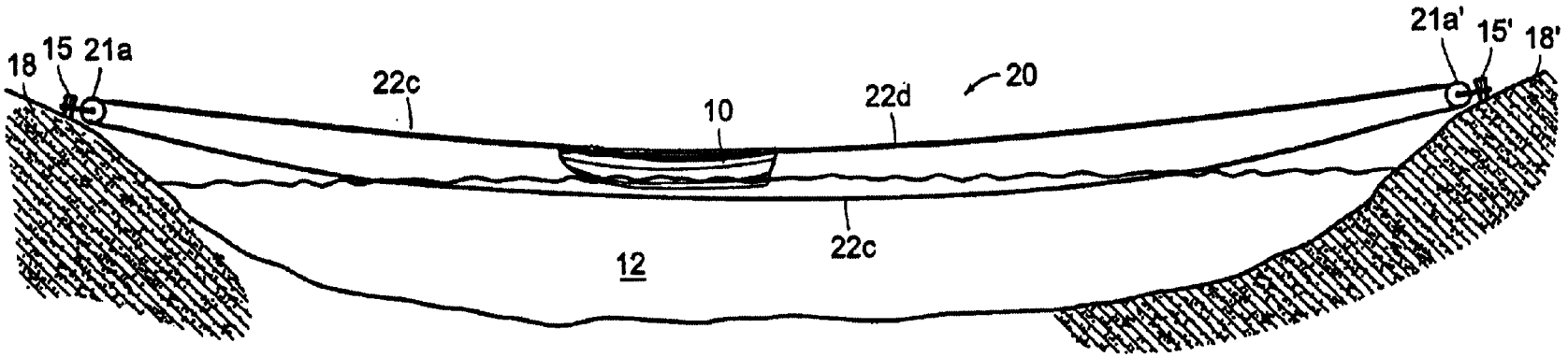

FIG. 5 shows another alternative embodiment corresponding to FIG. 4, but with the portable marine outhaul set between two land anchors 15, 15'. As with the FIG. 4 embodiment, this allows the boater to moor the boat, e.g. to fish, swim, or rest, and still have the ability to change its location along the length of the outhaul. This embodiment can also be used to ferry between two shores 18 and 18'. The variability of length and ease of operation of the outhaul of this invention allow this wide range of applications in widely varying natural settings.

Various modifications and alterations will occur to those skilled in the art. For example, while the invention has been described with respect to an enclosed reel, while that enclosure serves protective, line control, and reel support functions, the spool 24 can be open. It can be rotatably supported in myriad ways, and the lines can be guided to control tangling by a wide variety of mechanical arrangements that engage and/or guide and/or separate the lines as they wind and unwind from the reel. Further, a given outhaul length for an application is described being set by cleating the lines to the reel enclosure. This is a presently preferred arrangement, but it will also be understood that there are many known arrangements to secure a line that is wound on a reel at any given length. A slide clamp 40 is shown in phantom in FIG. 2C mounted on the exterior of the container 32. The spool can simply be locked against rotating using any of many known arrangements for locking a rotatable member. The lines can also be clamped.

There are likewise many equivalent ways to secure the line to the boat, other than cleating the line as in FIG. 1A. In a very simple form, the spool can be secured to the boat and locked against rotation. An enclosed reel can itself be secured to the boat. The line can be cleated to the boat directly, bypassing a cleating to the reel housing.

The spool 23 has been described as a single spool with a dividing flange. These functions can be performed by two spools that are coupled to rotate in unison, whether with a common axis of rotation or separate axes of rotation, or a single spool with a separate dividing wall mounted on an enclosure and extending toward the spool to separate the two runs of line wound on the spool.

The line has been described as standard marine line in various diameters and lengths. Other materials can be used, and other dimensions can be used to accommodate different sizes of boats, different end uses, and differing trade-offs as to the competing design considerations noted above. The principle limit on the length of the line is the size and weight of the line when it is wound for transport or storage. Trade-offs, for example, between the strength and tangle-resistance versus weight and bulk are noted above.

These and other variations and modifications that will occur to those skilled in the art from the foregoing detailed description and drawings are intended to fall within the scope of the appended claims.

What is claimed is:

1. A marine outhaul between a pair of pulleys secured to a pair of mutually spaced anchors, comprising:

a reel with a rotatable spool, and a loop of haul line journalled on said pulleys and secured to the rotatable spool to wind and unwind two runs simultaneously, in response to the rotation of said spool and the direction of said rotation.

2. The portable marine outhaul of claim 1 further comprising means for securing said wound-out outhaul line at any given length up to its full length.

3. The portable marine outhaul of claim 1 wherein said reel includes means for maintaining said runs in a mutually spaced relation adjacent said reel as they wind on and unwind from said reel.

4. A portable marine outhaul for a vessel that can be set at a variable distance from a first anchor comprises:

a sea anchor, including an anchor line secured to a float, a reel and haul line wound on said reel, said reel being constructed to wind and unwind said haul line as two mutually spaced runs of generally equal length, a pair of pulleys that carry the haul line, one of said pulleys being releasably secured to the sea anchor and float, and a second of said pulleys being releasably secured to the first anchor, means for securing said haul line when unwound out from said reel at a predetermined length, and means for securing one run of said haul line to the vessel, whereby drawing on one of said runs causes said haul line and the attached vessel to travel between said pulleys and their associated anchors, with the direction of movement of said vessel between said sea anchor and the first anchor depending on the direction of movement of said drawing.

5. The portable marine outhaul of claim 4 further comprising a housing, and said reel comprises a rotatable reel mounted within said housing, with said haul line double wound on said reel to wind or unwind as said two runs.

6. The portable marine outhaul of claim 5 wherein said housing generally encloses said reel and the portion of outhaul line wound on said reel, and said housing has a pair of mutually spaced openings through which'said runs pass.

7. The portable marine outhaul of claim 6 wherein said means for securing said haul line at a predetermined length comprises means mounted on said housing at its exterior for releasably securing both of said runs to set said variable outhaul length at a site-selected value.

8. The portable marine outhaul of claim 7 wherein said securing means is a cleat, and wherein said means for securing one run of said haul line comprises a cleat secured to said vessel.

9. The portable marine outhaul of claim 4 wherein said pair of pulleys each include snap attachments to said anchors.

10. The portable marine outhaul of claim 4 wherein said outhaul line has a total length 300 to 400 feet.

11. The portable marine outhaul of claim 5 comprises a hand crank external to said housing and coupled to said reel to rotate it to wind or unwind said haul line.

12. A method of mooring a floating marine vessel at a variable distance between a pair of anchor points comprising the steps of setting a first anchor, securing a reeled, double-run haul line to said first anchor, unreeling the said haul line in two runs in coordination with a movement of the vessel from said first anchor to a second anchor, detachably securing said haul line to said second anchor, securing the haul line at the length unreeled during said movement and said detachable securing, fixing said haul line to said vessel, and pulling on a run of said haul line thereby to move the vessel between said first and second anchors.

13. The mooring method of claim 12 wherein said first anchor is a sea anchor and said setting includes buoying an anchor line and attached pulley and outhaul lines.

14. The mooring method of claim 12 further comprising the step of separating said double runs at the point of said reeling to control tangling of said haul line.

15. The mooring method of claim 12 further comprising the step of enclosing said haul line in a housing when it is reeled.

16. The mooring method of claim 12 wherein said securing of said haul line at a given length comprises cleating said line to said housing.

17. The mooring method of claim 12 wherein said fixing comprises cleating said haul line to the vessel.

* * * * *